US007004104B1

(12) United States Patent
Kundus

(10) Patent No.: US 7,004,104 B1
(45) Date of Patent: Feb. 28, 2006

(54) ADJUSTABLE GOLF FLAGSTICK

(76) Inventor: Jerome Kundus, P.O. Box 111242, Pittsburgh, PA (US) 15238

( * ) Notice: Subject to any disclaimer, the term of this patent is extended or adjusted under 35 U.S.C. 154(b) by 0 days.

(21) Appl. No.: 11/013,127

(22) Filed: Dec. 15, 2004

Related U.S. Application Data

(60) Provisional application No. 60/529,089, filed on Dec. 15, 2003.

(51) Int. Cl.
*G09F 17/00* (2006.01)

(52) U.S. Cl. ..... 116/173; 116/209; 33/494; 473/176

(58) Field of Classification Search ..... 116/173–175, 116/209; 33/494, 296, 809–812, 679.1; 473/176
See application file for complete search history.

(56) References Cited

U.S. PATENT DOCUMENTS 3,082,943 A * 3/1963 Zenor ..... 235/61 D
3,240,183 A * 3/1966 Walter et al. ..... 116/173
3,760,441 A * 9/1973 Handelman ..... 441/11
3,963,360 A 6/1976 Fedrigo
4,037,839 A * 7/1977 Nelson ..... 463/47.7
4,508,467 A 4/1985 Choffin
4,905,624 A * 3/1990 Krolzick ..... 116/173
4,970,797 A * 11/1990 Sarasin ..... 33/494
5,572,835 A 11/1996 Atkins
5,615,635 A 4/1997 Deviney
5,975,009 A 11/1999 Nihra
6,065,787 A * 5/2000 Jarosch ..... 294/19.1
6,076,267 A * 6/2000 Gotoh ..... 33/293
6,354,629 B1 3/2002 McNeal
2003/0017890 A1 1/2003 McDonald

* cited by examiner

*Primary Examiner*—Diego Gutierrez
*Assistant Examiner*—Tania Courson
(74) *Attorney, Agent, or Firm*—Bruce E. Weir

(57) ABSTRACT

A golf flagstick with telescoping sections displays patterns, colors, or other visual indicators on sections. A given visual indicator may be displayed by extending a section or hidden by retracting the section. By extending and retracting combinations of specific sections, linear sequences of visual indicators corresponding to different hole positions on a golf green may be displayed to distant golfers, assisting the golfers in aiming drives to optimize ball placement.

10 Claims, 2 Drawing Sheets

ADJUSTABLE GOLF FLAGSTICK

CROSS-REFERENCE TO RELATED APPLICATION

This application claims priority from provisional patent application Ser. No. 60/529,089, filed Dec. 15, 2003 by the same inventor.

BACKGROUND

A golfer usually approaches a hole by first driving the ball toward the green from a considerable distance. Ideally, the ball would bounce and roll into the hole on the first stroke. As this rarely occurs, most golfers settle for trying to place the ball on the green close enough to the hole to sink the next shot with a single putt.

Since a hole may be difficult to see from a distance, golf courses may offer assistance in the form of a numbered flagstick placed in each hole. However, even the location of the flagstick on the green may from a distance be hard to gauge with enough precision to optimize ball placement. For example, if a given hole is on the left rear portion of a green, a drive toward the center may force the golfer to putt repeatedly and earn a poor score. Instead, the golfer may wish to drive the ball slightly harder and somewhat to the right of the hole to avoid falling short or missing the green altogether while obtaining good ball placement.

The golfer's effort may be facilitated by encoding information on hole position in the appearance of some object on the green. The flag and flagstick, being already present and visible for some distance, are convenient choices. Some courses have attempted to encode distance information in the flag itself, using different flags for near, medium, and far hole positions. However, this system requires at least three different flags for each hole and still provides no information on right or left hole position. A convenient flexible system for providing both range and direction information could improve a golfer's game while minimizing course maintenance work and expense.

SUMMARY

The present invention provides such a system in the form of a golf flagstick with a plurality of sections that telescope outward from within each end of a central tube. Locking mechanisms allow the position of each section to be temporarily fixed with respect to adjacent sections. A visual indicator, usually a pattern or a color, is displayed on at least a portion of the outer surface of the central tube. The same visual indicator may be displayed on at least a portion of the surface of at least one of the sections telescoping from each end of the central tube. Other telescoping sections display different visual indicators. Since a visual indicator on a telescoping section is visible only when the telescoping section is extended, and since each telescoping section may be independently extended from or retracted into a larger section, many different linear sequences of visual indicators may be displayed along the length of the flagstick simply by extending and retracting selected sections. When sequences of visual indicators are preselected to correspond to hole position on a golf green, a flagstick of the present invention may be easily adjusted to display hole position information at a distance.

All of these features and advantages of the present invention, and more, are illustrated below in the drawings and detailed description that follow.

DETAILED DESCRIPTION

Figure 1:
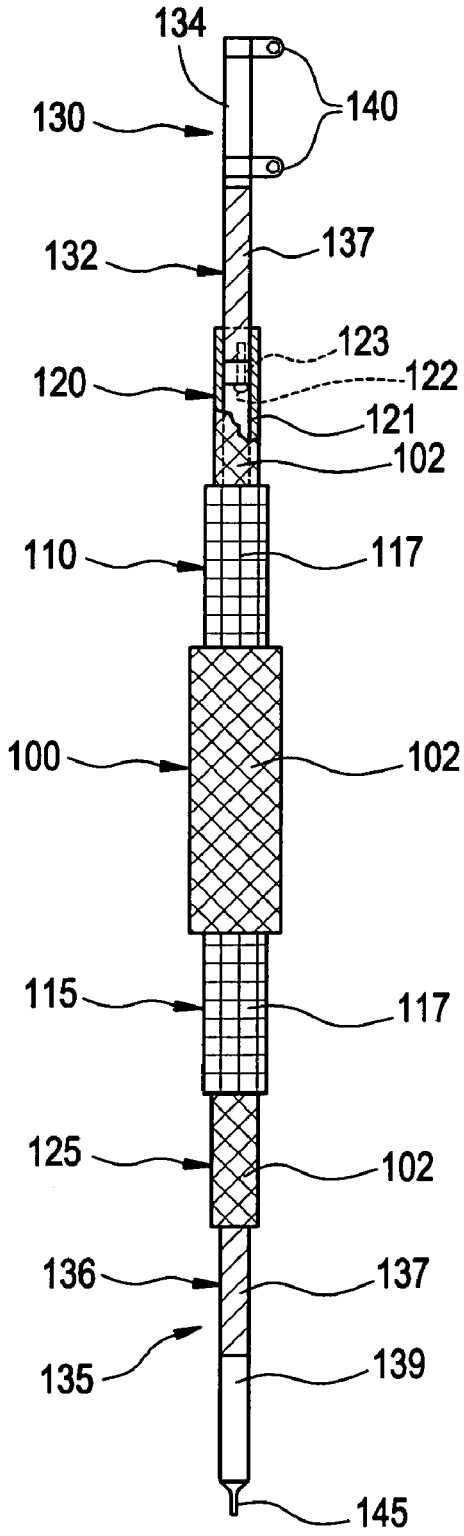
FIG. 1 shows an elevation view of a preferred embodiment of the present invention with all sections fully expanded.

FIG. 1 shows an elevation view of a preferred embodiment of the present invention with all sections fully expanded. The apparent diameters of the sections in FIG. 1 are greatly exaggerated relative to their apparent lengths to clarify the relationships of the components, whereas the invention in use would typically appear more like a series of telescoping wands of any length needed to provide a flagstick of desired total length. The sections utilized in this embodiment are concentric hollow cylinders, but triangular, square, hexagonal, octagonal, U-channel, and many other cross-sectional shapes may be employed. The sections may comprise aluminum, plastic, fiberglass, or any other suitable material known in the art.

In the embodiment of FIG. 1 a tubular central section 100 has a visual indicator 102 displayed on its outer surface and an inner diameter slightly larger than the outer diameters of cooperating sections 110, 115. The visual indicators in FIG. 1. are shown as line patterns for clarity of reproduction. In use, however, preferred visual indicators would be colors, perhaps used in conjunction with patterns. Any visually distinctive indicator that may be applied to or manufactured as part of a section will suffice. The central section 100 is long enough to receive both cooperating sections 110, 115 when they are fully retracted, thereby concealing the visual indicators 117.

Smaller diameter sections 120, 125 are similarly received and concealed by larger sections 110, 115. In the embodiment of FIG. 1 these sections 120, 125 display the same visual indicator 102 as the central section 100, but other visual indicators could be displayed instead. A portion 132 of a top section 130 displaying a visual indicator 137 is received by and may be concealed within a larger cooperating section 120. Another portion 134 of the top section 130 displays no visual indicator and always remains extended beyond the cooperating section 120. In FIG. 1 grommets 140 provide a convenient means for attaching a flag, although swivel wires, snap locks, and any other known flag attachment means may be used instead.

Each section may be temporarily locked to cooperating sections by a variety of known means. The preferred embodiment in FIG. 1 shows a cylindrical cam 123 affixed to an end of the top section 130 by a machine screw 122. Since the outer diameter of the cam 123 is slightly smaller than the inner diameter 121 of the cooperating section 120, axially twisting the top section 130 with respect to the cooperating section 120 temporarily locks the two sections together at any chosen point within their range of travel. Similar cam locks may be used between all sections. Alternatively, sections may be locked together by pins, snap rings, levered cams, spring-loaded balls in detents, threaded collars screwed down onto tapered threads, or any other known means for locking two telescoping sections together.

A portion 136 of a bottom section 135 displaying a visual indicator 137 is received by and may be concealed within a larger cooperating section 125. Another portion 139 of the bottom section 135 displays no visual indicator and always remains extended beyond the cooperating section 125. A ferrule 145 provide a convenient means for affixing the flagstick within a hole and may include an a cup, b cup, h ferrule, hexagon, and any other known flagstick mounting means.

FIG. 1 shows three distinct visual indicators 102, 117, 137 displayed on six sections 110, 115, 120, 125, 130, 135 of decreasing diameter that symmetrically telescope outward from the central section 100. While this embodiment provides a simple and adaptable flagstick, more or fewer sections and visual indicators may be used as desired. Different numbers of sections and visual indicators, as well as different section diameters and/or visual indicators may be used above and below the central section. Sections may increase or alternate in diameter and/or telescope only in one direction.

Figure 2:
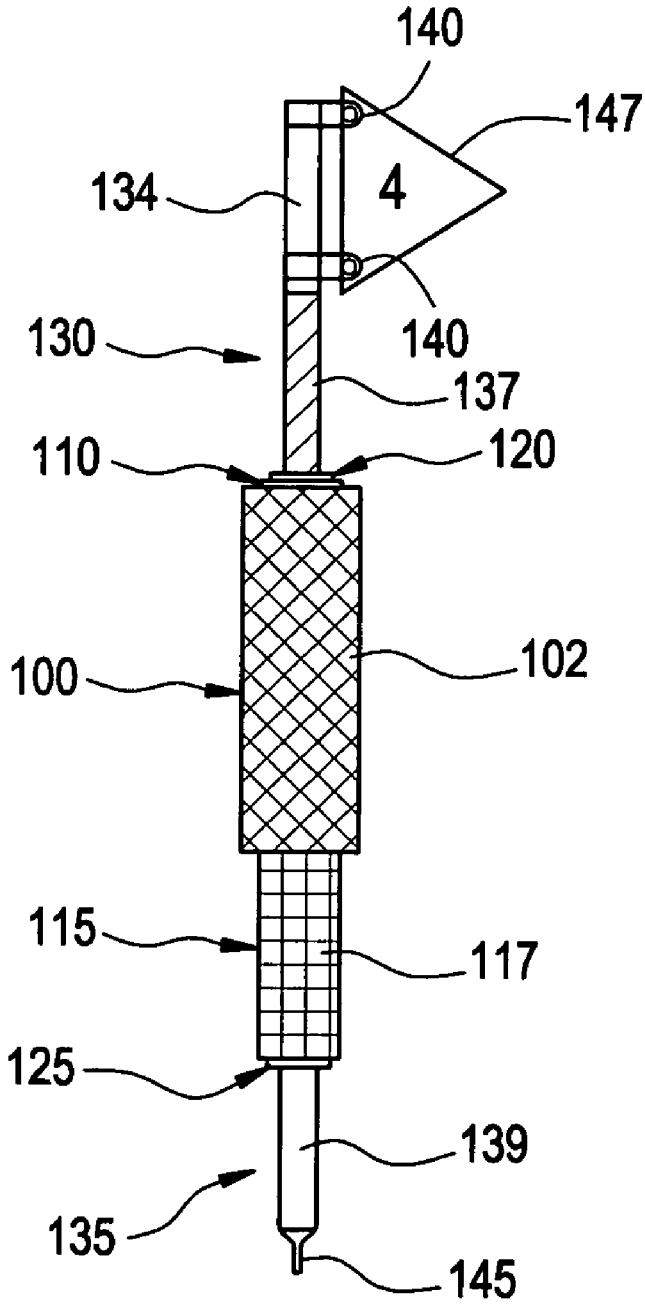
FIG. 2 shows an elevation view of a preferred embodiment of the present invention with three visual indicators displayed.

FIG. 2 shows an elevation view of a preferred embodiment of the present invention with three visual indicators displayed. With the top section 130 fully extended, two cooperating sections 110, 120 fully retracted, a lower section 115 fully extended, and a cooperating section 125 and the bottom section 135 fully retracted, the pole displays only an upper visual indicator 137, the always-visible indicator 102 on the central section 100, and a lower visual indicator 117. This combination of visual indicators in a specific linear sequence of display positions can denote many kinds on information. With the ferrule 145 inserted in the hole and a flag 147 attached to grommets 140, the flagstick of FIG. 2 may communicate to a distant golfer the area of the green where the hole is located.

A large number of sequences may be displayed by the flagstick of the present invention, limited only by the number of sections and visual indicators. Nine distinct sequences are sufficient to communicate hole position on a green, respectively Front Left (FL), Front Center (FC), Front Right (FR), Middle Left (ML), Middle Center (MC), Middle Right (MR), Back Left (BL), Back Center (BC), and Back Right (BR). Table 1 shows possible color/position sequences corresponding to these hole positions. Many other combinations of color, position, and pattern could be used to the same effect.

TABLE 1

| BL | BC | BR |
|---|---|---|
| Top white<br>Middle white<br>Bottom blue | Top blue<br>Middle white<br>Bottom blue | Top blue<br>Middle white<br>Bottom white |
| **ML** | **MC** | **MR** |
| Top blue<br>Middle white<br>Bottom red | Top white<br>Middle white<br>Bottom white | Top red<br>Middle white<br>Bottom blue |
| **FL** | **FC** | **FR** |
| Top white<br>Middle white<br>Bottom red | Top red<br>Middle white<br>Bottom red | Top red<br>Middle white<br>Bottom white |

The resulting system is adaptable and simple to use. Suitable visual indicators are selected and regions for their display are defined on the flagstick. The number of discrete states to be communicated is determined; in this case, nine possible hole positions. A distinct combination of visual indicators and display positions is defined for each state. The actual position of a hole on a specific green in determined and the flagstick is adjusted to display only the distinct combination of visual indicators and display positions defined for this hole position. The flag may be attached, the flagstick is placed in the hole, and the golfer proceeds.

The principles, embodiments, and modes of operation of the present invention have been set forth in the foregoing specification. The embodiments disclosed herein should be interpreted as illustrating the present invention and not as restricting it. The foregoing disclosure is not intended to limit the range of equivalent structure available to a person of ordinary skill in the art in any way, but rather to expand the range of equivalent structures in ways not previously contemplated. Numerous variations and changes can be made to the foregoing illustrative embodiments without departing from the scope and spirit of the present invention.

I claim:

1. A system for indicating the position of a golf hole, comprising:

a golf hole;

a golf flagstick, the golf flagstick having a central section, a plurality of cooperating upper sections, and a plurality of cooperating lower sections;

the central section comprising a tube, the central section having an upper end, a lower end, and a visual indicator disposed upon at least a portion of its outer surface;

the plurality of cooperating upper sections operable to telescope through the upper end from within the central section, each upper section having a visual indicator disposed upon at least a portion of its outer surface; and the plurality of cooperating lower sections operable to telescope through the lower end from within the central section, each lower section having a visual indicator disposed upon at least a portion of its outer surface, each visual indicator selected to comprise a portion of a visual pattern indicating the position of the golf hole.

2. A system for indicating the position of a golf hole as claimed in claim 1, further comprising means for locking the position of each section with respect to adjacent sections.

3. A system for indicating the position of a golf hole as claimed in claim 1, further comprising means for attaching a flag to an upper section.

4. A system for indicating the position of a golf hole as claimed in claim 1, further comprising means for affixing a lower section within a hole on a golf green.

5. A system for indicating the position of a golf hole as claimed in claim 1, wherein the visual indicators are colors.

6. A system for indicating the position of a golf comprising:

a golf hole;

a golf flagstick, the golf flagstick having a central section, a first upper section, a second upper section, a top section, a first lower section, a second lower sections and a bottom section;

the central section comprising a tube and having an upper end and a lower end, the central section having a first visual indicator disposed upon at least a portion of its outer surface;

the first upper section slideably received within the central section through the upper end, the first upper section having a second visual indicator disposed upon at least a portion of its outer surface;

means operable to fix the relative positions of the central section and the first upper section;

the second upper section slideably received within the first upper section, the second upper section having a third visual indicator disposed upon at least a portion of its outer surface;

means operable to fix the relative positions of the first upper section and the second upper section;

the top section slideably received within the second upper section, the top section having a fourth visual indicator disposed upon at least a portion of its outer surface;

means operable to fix the relative positions of the second upper section and the top section;

the first lower section slideably received within the central section through the lower end, the first lower section having a fifth visual indicator disposed upon at least a portion of its outer surface;

means operable to fix the relative positions of the central section and the first lower section;

the second lower section slideably received within the first lower section, the second lower section having a sixth visual indicator disposed upon at least a portion of its outer surface;

means operable to fix the relative positions of the first lower section and the second lower section;

the bottom section slideably received within the second lower section, the bottom section having a seventh visual indicator disposed upon at least a portion of its outer surface, each visual indicator selected to comprise a portion of a visual pattern indicating the position of the golf hole; and means operable to fix the relative positions of the second lower section and the bottom section.

7. A system for indicating the position of a golf hole golf flagstick as claimed in claim 6, further comprising means for attaching a flag to the top section.

8. A system for indicating the position of a golf hole golf flagstick as claimed in claim 6, further comprising means for affixing the bottom section within a hole on a golf green.

9. A system for indicating the position of a golf hole golf flagstick as claimed in claim 6, wherein the visual indicators are colors.

10. A method for signaling the position of a hole on a golf green with a golf flagstick, comprising:

selecting at least three different visual indicators capable of disposition upon the golf flagstick;

defining at least three display positions on the golf flagstick, each position suitable for display of a visual indicator;

defining hole positions on the golf green where a hole may be located;

defining a plurality of combinations of visual indicators in display positions wherein each combination corresponds to a unique hole position;

determining the hole position of a hole on the golf green;

adjusting the golf flagstick to display a selected combination of visual indicators in display positions wherein the selected combination corresponds to the determined hole position; and placing the golf flagstick on the golf green.

* * * * *